US010295138B2

(12) United States Patent
Okubo

(10) Patent No.: US 10,295,138 B2
(45) Date of Patent: May 21, 2019

(54) VEHICLE LAMP

(71) Applicant: ICHIKOH INDUSTRIES, LTD., Isehara-shi, Kanagawa-ken (JP)

(72) Inventor: Yasuhiro Okubo, Isehara (JP)

(73) Assignee: ICHIKOH INDUSTRIES, LTD., Isehara-shi (JP)

( * ) Notice: Subject to any disclaimer, the term of this patent is extended or adjusted under 35 U.S.C. 154(b) by 0 days.

(21) Appl. No.: 15/569,905

(22) PCT Filed: May 19, 2016

(86) PCT No.: PCT/JP2016/064927
§ 371 (c)(1),
(2) Date: Oct. 27, 2017

(87) PCT Pub. No.: WO2016/186179
PCT Pub. Date: Nov. 24, 2016

(65) Prior Publication Data

US 2018/0106445 A1 Apr. 19, 2018

(30) Foreign Application Priority Data

May 21, 2015 (JP) ..... 2015-103879

(51) Int. Cl.
*F21S 8/10* (2006.01)
*F21V 13/00* (2006.01)
(Continued)

(52) U.S. Cl.
CPC ..... *F21S 41/285* (2018.01); *F21S 41/141* (2018.01); *F21S 41/143* (2018.01); *F21S 41/192* (2018.01);
(Continued)

(58) Field of Classification Search
CPC ..... F21S 41/25; F21S 41/285; F21S 41/143; F21S 41/265; B60Q 1/04
See application file for complete search history.

(56) References Cited

U.S. PATENT DOCUMENTS 7,798,378 B2 * 9/2010 Baughman ..... B65D 25/44 222/529
9,896,023 B1 * 2/2018 Salter ..... B60Q 1/22
(Continued)

FOREIGN PATENT DOCUMENTS

JP 2013-073811 A 4/2013
JP 2013-149443 A 8/2013
(Continued)

*Primary Examiner* — Karabi Guharay
(74) *Attorney, Agent, or Firm* — Foley & Lardner LLP

(57) ABSTRACT

This vehicle lamp includes a light source part having a semiconductor-type light source, a second lens disposed in front of the light source and having a second lens part, and a first lens disposed between the light source and the second lens and having a first lens part that converts a light cone of the light source into a cone connecting the second lens part and a basic focal point P of the second lens part, wherein the first lens part is formed such that it radiates the light coming from the light source and entering an incident surface located on the horizontally outer side of the first lens part after converting it into inward light so that the light enters an incident surface located on the horizontally outer side of the second lens part.

8 Claims, 7 Drawing Sheets

(51) Int. Cl.

| | |
|---|---|
| ***F21S 41/20*** | (2018.01) |
| ***F21S 41/143*** | (2018.01) |
| ***F21S 41/25*** | (2018.01) |
| ***F21S 41/265*** | (2018.01) |
| ***F21S 41/19*** | (2018.01) |
| ***F21S 41/141*** | (2018.01) |
| ***F21S 41/29*** | (2018.01) |
| ***F21S 45/47*** | (2018.01) |
| ***F21V 17/12*** | (2006.01) |
| *F21Y 115/10* | (2016.01) |
| *F21W 102/13* | (2018.01) |

(52) U.S. Cl.

CPC ..... *F21S 41/25* (2018.01); *F21S 41/265* (2018.01); *F21S 41/29* (2018.01); *F21S 45/47* (2018.01); *F21V 17/12* (2013.01); *F21S 41/19* (2018.01); *F21S 41/295* (2018.01); *F21W 2102/13* (2018.01); *F21Y 2115/10* (2016.08)

(56) References Cited

U.S. PATENT DOCUMENTS

| | | | |
|---|---|---|---|
| 2015/0043238 | A1 | 2/2015 | Yamamoto et al. |
| 2015/0211709 | A1 | 7/2015 | Uchida et al. |

FOREIGN PATENT DOCUMENTS

| | | | |
|---|---|---|---|
| JP | 2015-032547 | A | 2/2015 |
| WO | WO-2014/017652 | A1 | 1/2014 |

* cited by examiner

[FIG. 1]
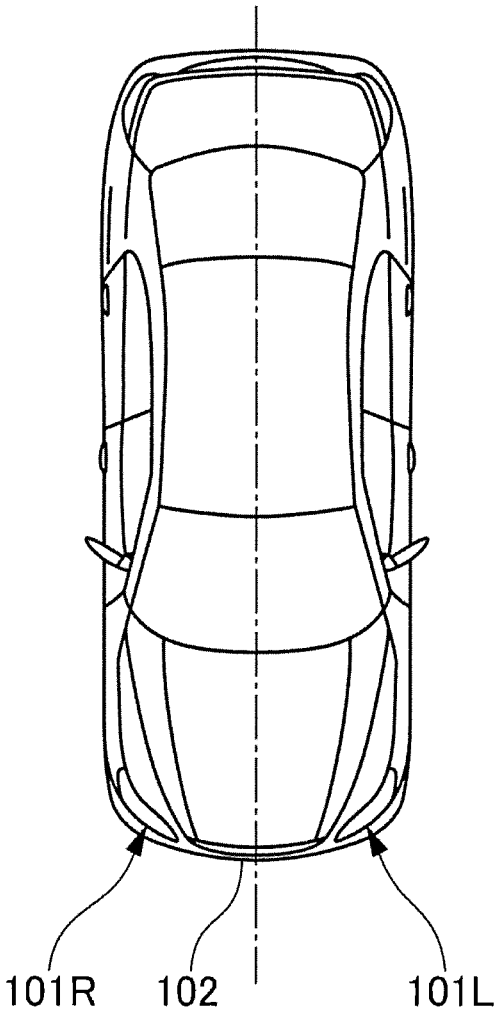

[FIG. 2]
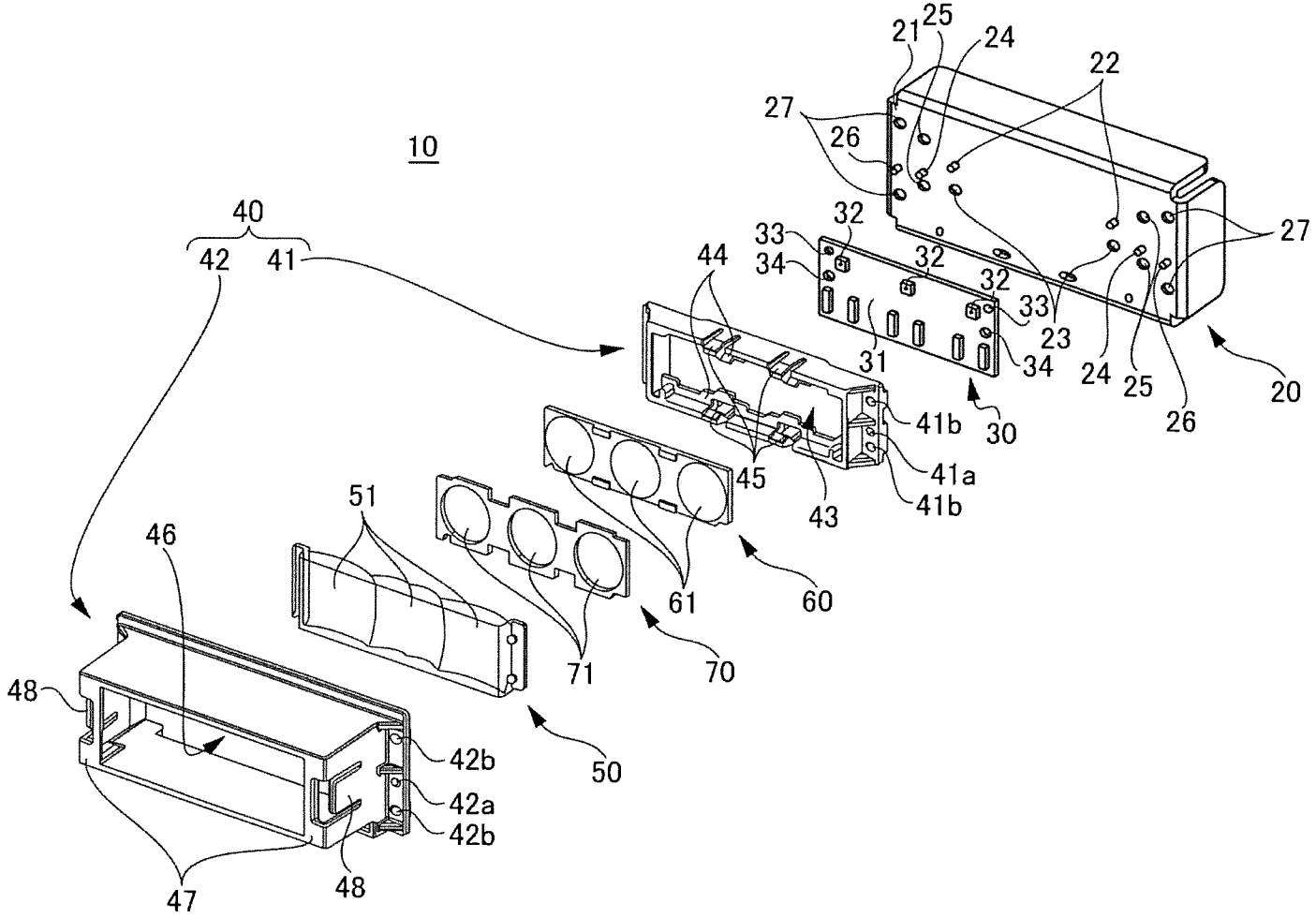

[FIG. 3]
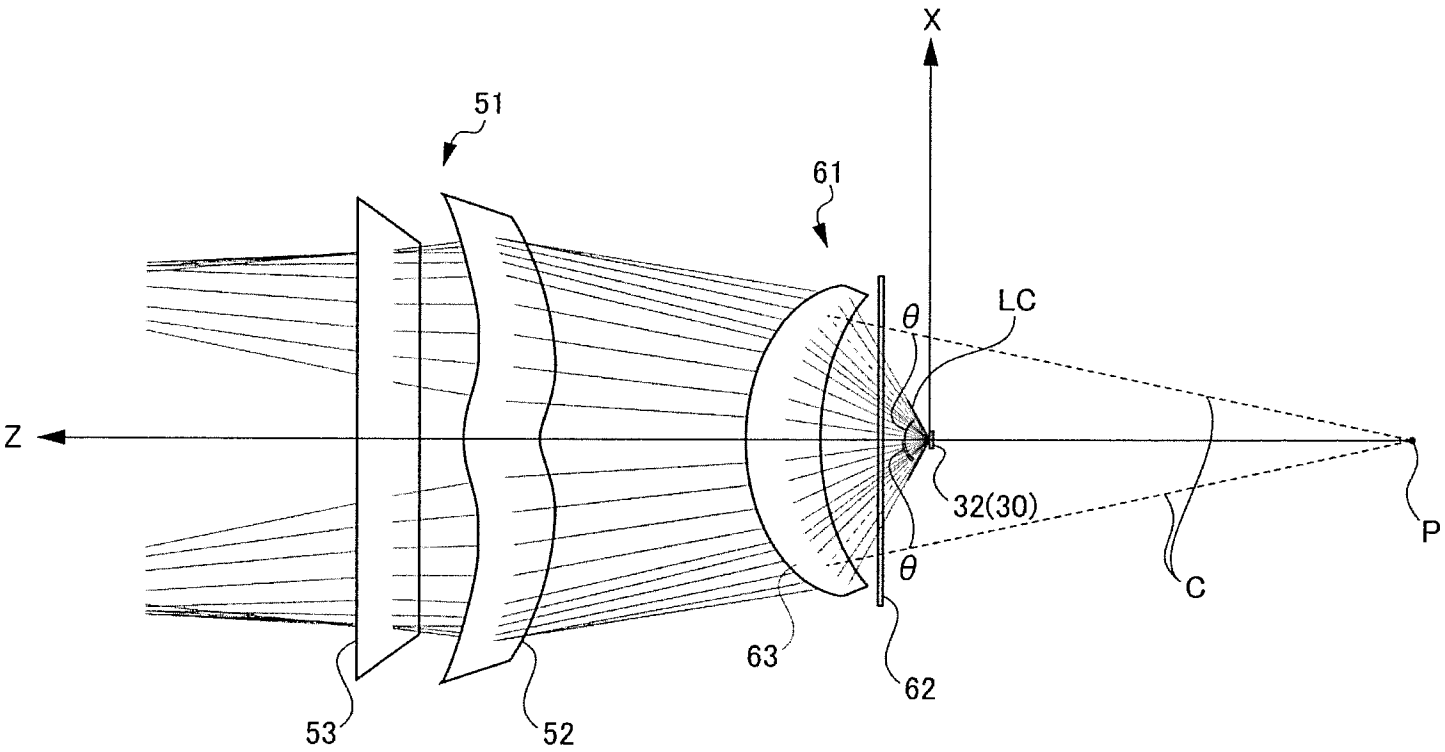

[FIG. 4]
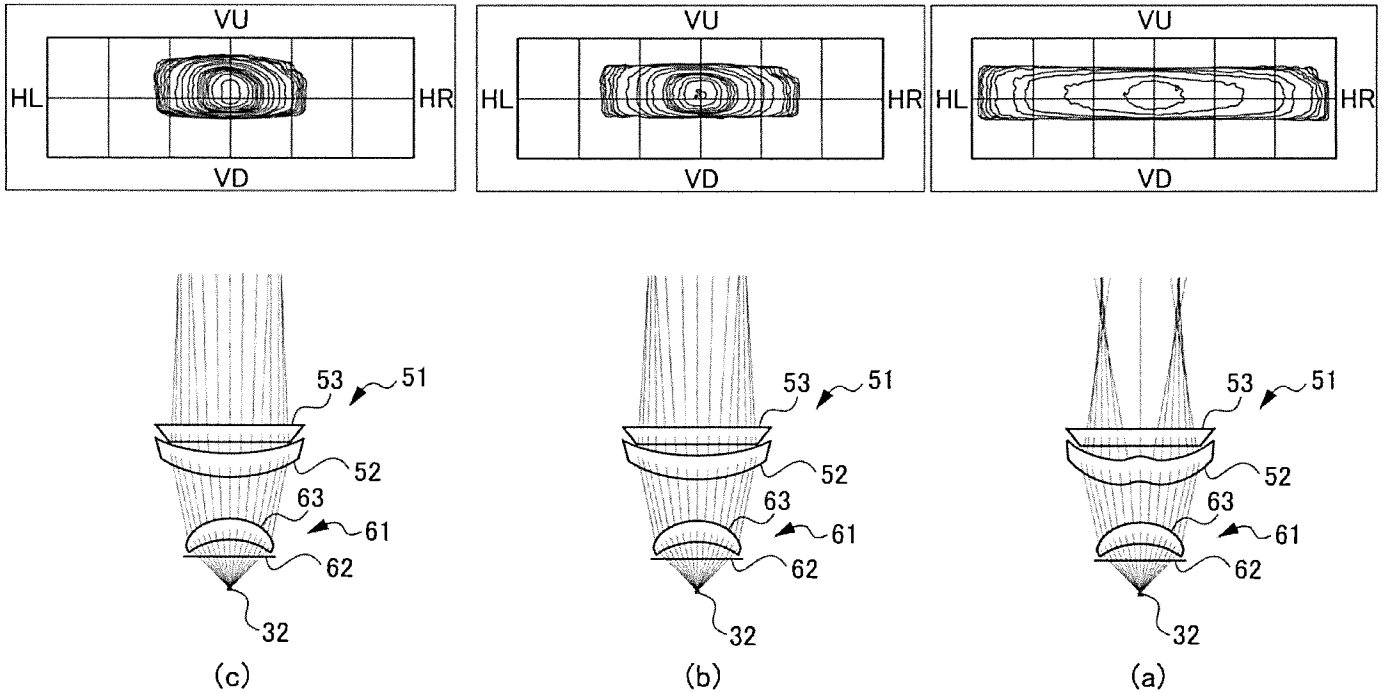

[FIG. 5]
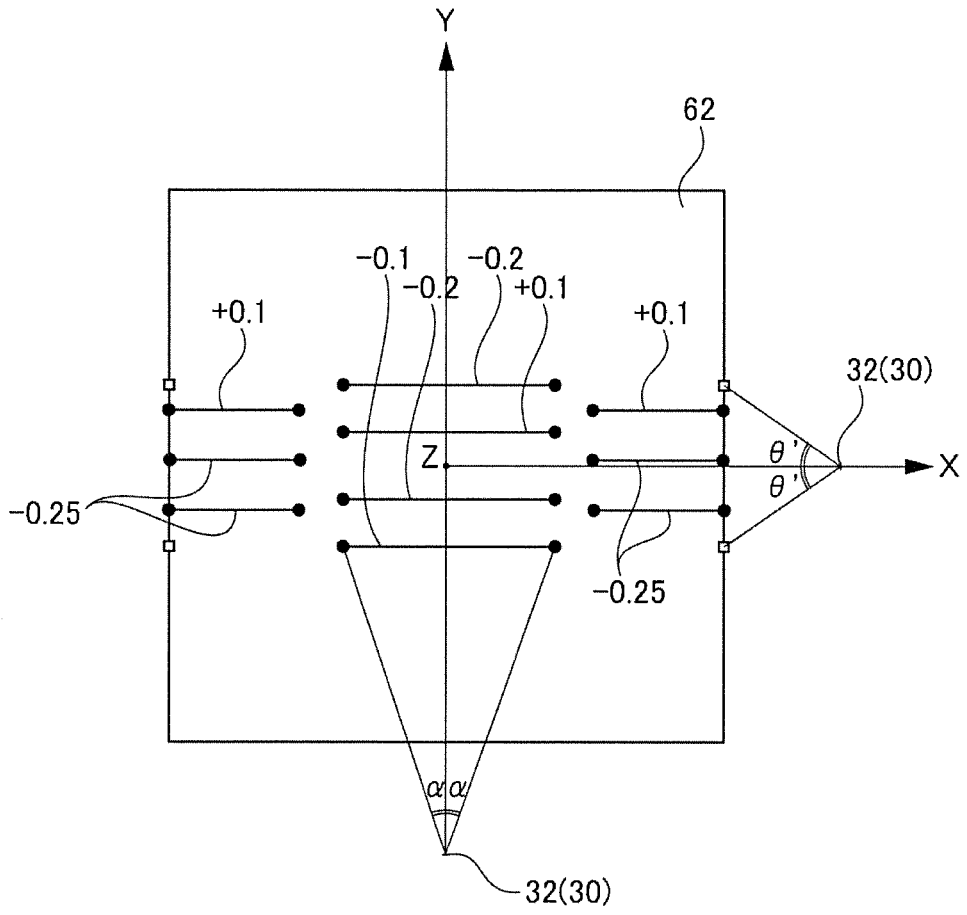

[FIG. 6]
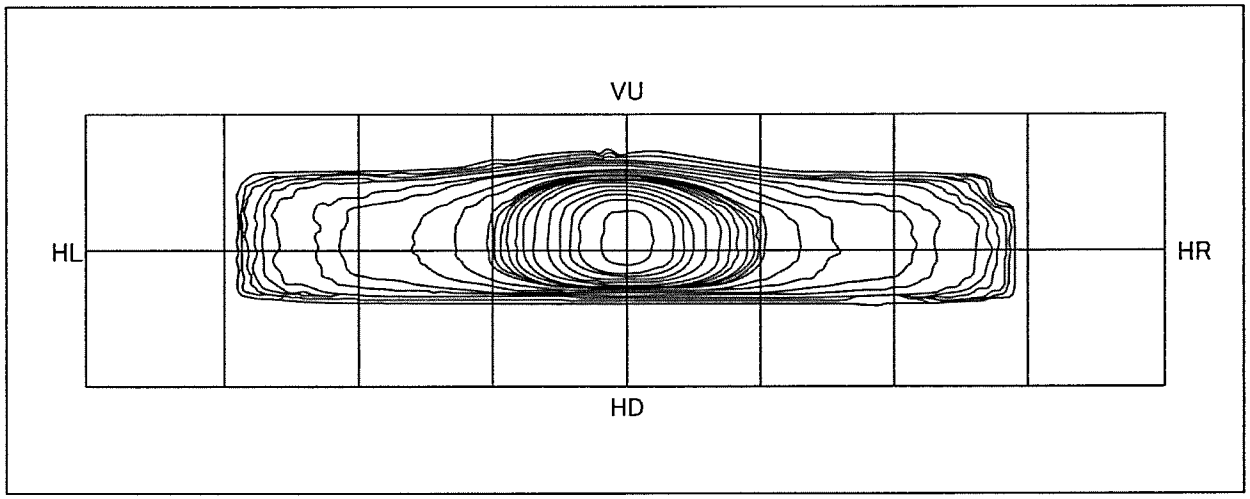

[FIG. 7]
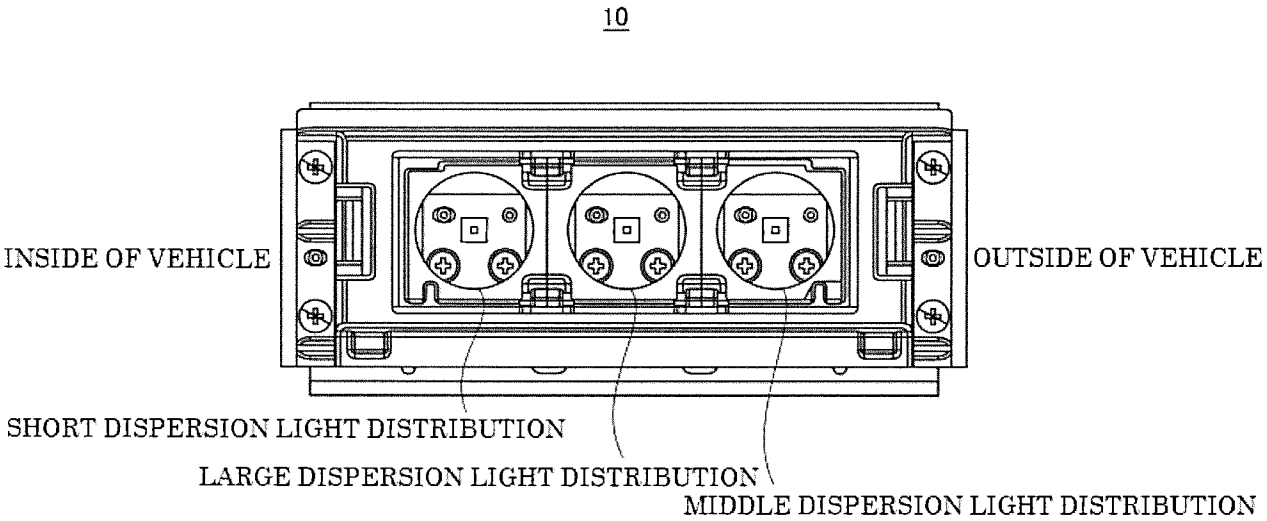

VEHICLE LAMP

TECHNICAL FIELD

The present invention relates to a vehicle lamp.

BACKGROUND ART

Conventionally, there is known a vehicle lamp unit which is provided with: a projection lens including a plurality of lenses disposed on an optical axis extending in a vehicle longitudinal direction; and a light source disposed at a rear side more significantly than a rear side focus surface of the projection lens and radiating a rear side finish surface of the projection lens, and which is characterized in that the rear side focus surface of the projection lens and the rear side finish surface of the projection lens are substantially coincident with each other, and on the rear side finish surface of the projection lens, a certain process of dispersing the light that is radiated by the light source is applied (refer to Patent Literature 1).

In addition, in Patent Literature 1, the following descriptive matters are set forth. That is, by employing the configuration as described above, in place of projecting an image of the light source which has been disposed in the vicinity of a rear side focal point of the projection lens (or an optical image formed in the vicinity of the rear side focal point of the projection lens by reflection light source from a reflection surface), an illuminance distribution is formed to have been uniformed on the rear side finish surface of the projection lens by way of action of the rear side finish surface of the projection lens that have been substantially coincident with the rear side focus surface of the projection lens (a fine, irregular shape exerted by emboss processing or the like applied to the rear side finish surface of the projection lens, for example). The thus uniformed illuminance distribution is enlarged and inverted and then projected forward via the projection lens; and therefore, it is possible to form predetermined light distribution patterns of the uniformed luminance distribution on a virtual vertical screen (which is disposed by about 25 m forward from a vehicle front surface, for example).

In addition, in Patent Literature 1, it is described that it is possible to restrain a color fringe exerted by color aberration, in comparison with a case in which a projection lens is composed of a single lens.

CITATION LIST

Patent Literature

Patent Literature 1: Japanese Unexamined Patent Application Publication No. 2013-73811

SUMMARY OF THE INVENTION

Problems to be Solved by the Invention

In the meantime, although, in Patent Literature 1, consideration is not so much taken with respect to downsizing of a vehicle lamp, in recent years, it has been consistently required to downsize such a vehicle lamp.

The present invention has been made in view of the circumstance described above, and it is an object of the present invention to provide a vehicle lamp which is capable of being downsized.

Means for Solving the Problem

In order to achieve the above object, the present invention is realized by the following constitution.

(1) A vehicle lamp of the present invention, comprising: a light source part having a semiconductor-type light source; a second lens having a second lens part which is disposed at a front side of the light source; and a first lens disposed between the light source and the second lens and having a first lens part to convert a light cone of the light source to a cone which connects the second lens part and a basic focal point of the second lens part to each other, wherein the first lens part is formed to inwardly convert and radiate light from the light source allowed to enter an incident surface outside in a horizontal direction of the first lens part so as to be allowed to enter an incident surface outside a horizontal direction of the second lens part.

(2) The vehicle lamp unit according to the (1), wherein the second lens part is formed so as to radiate light from outside to inside from a central side towards outside in a horizontal direction.

(3) The vehicle lamp unit according to the (1), wherein an incident surface in a range in a vertical direction of the first lens part, in which an irradiation angle of light from the light source is a predetermined angle or less with reference to a light source optical axis of the light source, is formed so that a focal point position of the second lens part is shifted in a vertical direction with respect to a basic focal point of the second lens part.

(4) The vehicle lamp unit according to the (1), wherein the first lens part has a backward focal distance of 3 mm or more and 10 mm or less, the first lens is formed of a material with a higher heat resistivity than a material for the second lens, and the first lens is disposed so that a light emission center of the light source part is positioned at or near a backward focal point of the first lens part.

(5) The vehicle lamp unit according to the (1), wherein the second lens is formed of an acrylic resin.

(6) The vehicle lamp unit according to the (1), wherein, in a case where a cutout is present at a part of a light emitting chip which is provided at the light source, the light emitting chip is disposed so that a cut out portion is positioned at a lower side in a vertical direction.

(7) The vehicle lamp unit according to the (1), wherein at the light source part, a plurality of light emitting chips are provided, at the first lens, the first lens part that corresponds to a respective one of the light emitting chips is formed in plurality, and at the second lens as well, the second lens part that corresponds to a respective one of the light emitting chips is formed in plurality.

(8) The vehicle lamp unit according to the (7), comprising a lamp unit for low beam, which is disposed outside of a vehicle, wherein at adjacent positions inside of the vehicle of the lamp unit for low beam, the light emitting chips, the first lens part, and the second lens part are disposed so as to be arranged in a vertical direction.

Effect of the Invention

According to the present invention, it is possible to provide a vehicle lamp which is capable of being downsized.

BRIEF DESCRIPTION OF THE DRAWINGS

FIG. 1 is a plan view of a vehicle which is provided with a vehicle lamp of an embodiment according to the present invention.

FIG. 2 is an exploded perspective view of a lamp unit of the embodiment according to the present invention.

FIG. 3 is a view for explaining a first lens part 61 and a second lens part 51 of the embodiment according to the present invention.

FIG. 4 is a view showing, by the iso-intensity curve, light distribution patterns on a screen which is formed by the light from the respective light emitting chips of the lamp unit of the embodiment according to the present invention, in which FIG. 4 (*a*) is a view showing a large dispersion light distribution pattern; FIG. 4 (*b*) is a view showing a middle dispersion light distribution pattern; and FIG. 4 (*c*) is a view showing a short dispersion light distribution pattern.

FIG. 5 is a view schematically showing a case in which an irradiation angle of the light in each of a horizontal direction and a vertical direction is within the range of 50 degrees with respect to an incident surface of a first lens part of the embodiment according to the present invention.

FIG. 6 is a view showing, by the iso-intensity curve, a high bam light distribution pattern on a screen which is formed by the lamp unit of the embodiment according to the present invention.

FIG. 7 is a front view of the lamp unit of the embodiment according to the present invention.

MODE FOR CARRYING OUT THE INVENTION

Hereinafter, mode for carrying out the present invention (hereinafter, referred to as the "embodiment") will be described in detail with reference to the accompanying drawings. Throughout the entire description of the embodiment, the same constituent elements are designated by the same reference numerals. In addition, unless set forth in particular in the embodiment and the figures, the terms "forward" and "backward" respectively designate the "forward direction" and the "backward direction", of the vehicle and the terms "upper", "lower", "leftward" and "rightward" respectively designate the directions as seen from a driver who is riding on a vehicle.

A vehicle lamp according to an embodiment of the present invention is a vehicle headlamp (101R, 101L) which is provided at a respective one of a front left and right of a vehicle 102 shown in FIG. 1, and hereinafter, this lamp is simply referred to as the "vehicle lamp".

The vehicle lamp of the embodiment is provided with an outer lens (not shown) which is mounted to a housing so as to cover an opening of the housing (not shown) opening towards a front side of the vehicle, and in a lamp room which is formed of the housing and the outer lens, a lamp unit 10 (refer to FIG. 2) or the like is disposed.

(Lamp Unit)

FIG. 2 is an exploded perspective view of the lamp unit 10.

As shown in FIG. 2, the lamp unit 10 is provided with: a heat sink 20; a light source part consisting of a semiconductor-type light source 30 which is mounted onto the heat sink 20; a lens holder 40 which is mounted onto the heat sink 20; a second lens 50 which is disposed at a front side of a light source 30; a first lens 60 which is disposed between the second lens 50 and the light source 30; and a shade 70 which is disposed between the first lens 60 and the second lens 50.

Incidentally, the light source part may be configured by employing a plurality of semiconductor-type light sources 30 which are composed of light emitting chips 32 and an aluminum package board 31, or alternatively, as in the embodiment, the light source part may be composed of a semiconductor-type light source 30 obtained by providing a plurality of light emitting chips 32 on one aluminum package board 31. Therefore, in the following description, a descriptive matter of the light source 30 is simply set forth, and a descriptive matter of the light source part is omitted, whereas an expression of the light source part is employed only with respect to a portion at which the light source 30 and the light source part are respectively required to be explained separately.

(Heat Sink)

It is preferable that the heat sink 20 be a member to radiate a heat generated by the light source 30 and be molded by employing a metal material (such as aluminum, for example) or a resin material of which thermal conductivity is high.

Although the embodiment presents a case of a heat sink 20 in a shape of a flat plate which has been formed by pressing a metal material of which thermal conductivity is high, the present invention is not limitative thereto. For example, this heat sink may be an aluminum die-cast heat sink in which a heat radiation fin extending backward is provided on a back face located at an opposite side to a surface 21 on which the light source 30 is to be disposed.

However, manufacturing costs thereof can be restrained more efficiently by forming the heat sink 20 by way of pressing; and therefore, from the viewpoints of cost reduction, as in the embodiment, it is preferable to employ the heat sink 20 in the shape of the flat plate formed by way of pressing.

In the surface 21 of the heat sink 20, a boss 22 for alignment when mounting the light source 30 and a screw fixing hole 23 to fix a screw (not shown) for mounting the light source 30 are formed.

In addition, in the surface 21 of the heat sink 20, a boss 24 for alignment when a first lens holder 41 of a lens holder 40 is mounted and a screw fixing hole 25 to fix a screw (not shown) for mounting the first lens holder 41 are formed.

Further, in the surface 21 of the heat sink 20, a boss 26 for alignment when mounting a second lens holder 42 of the lens holder 40 and a screw fixing hole 27 to fix a screw (not shown) for mounting the second lens holder 42 are formed.

Thus, the light source 30, the first lens holder 41, and the second lens holder 42 are respectively aligned with the bosses 22, 24, and 26 that have been provided on the surface 21 of the heat sink 20. Afterwards, the screws are fixed to the screw fixing holes 23, 25, and 27 that have been provided on the surface 21 of the heat sink 20, so that the light source 30, the first lens holder 41, and the second lens holder 42 can be thereby fixed, respectively.

(Light Source)

The lamp unit 10 of the embodiment forms a high beam light distribution pattern by overlapping three light distribution patterns, i.e., a short dispersion light distribution pattern, a middle dispersion light distribution pattern, and a large dispersion light distribution pattern. As shown in FIG. 2, in the lamp unit 10, there is provided the light source 30 having a total of three light emitting chips 32 on a one by one basis for the respective one of the light distribution patterns.

More specifically, the lamp unit 10 is an LED light source obtained by providing three light emitting chips 32 on the aluminum package board 31 on which a power feeding structure has been provided.

Incidentally, as described above, in the embodiment, one aluminum package board 31 is provided as a common board; a light source part is composed of the light source 30 in such a manner that the three light emitting chips 32 are provided on the aluminum package board 31; and the light source part has the three light emitting chips 32; and however, for example, a light source part may be configured by employing three light sources 30, each of which consists of one light emitting chip 32 and one aluminum package board 31. By doing something like this as well, as in the embodiment, it is possible to employ the light source part in which the three light emitting chips have been provided.

In the aluminum package board 31, there are provided: a boss hole 33 through which the boss 22 of the heat sink 20 is to be inserted; and a screw hole 34 for passing a screw (not shown) when the screw is fixed to the heat sink 20. In addition, after the light source 30 has been disposed on the heat sink 20 so as to insert the boss 22 through the boss hole 33, the screw (not shown) is screwed and fixed into the screw fixing hole 23 of the heat sink 20 through the screw hole 34, and the light source 30 is thereby fixed onto the heat sink 20.

Although, in the embodiment, the light source 30 provides the light emitting chips 32 on the one by one basis for each light distribution pattern, and there is no need to limit provision of the light emitting chips 32 on the one by one basis for each light distribution pattern. However, if the plurality of light emitting chips 32 is provided in a set for one light distribution pattern, the number of light emitting chips 32 is increased and thus a heat value also is increased.

In this case, the first lens 60 causes a degradation due to the heat and thus there may be a case in which the first lens 60 cannot be disposed so as to be close to the light source 30 for the sake of downsizing.

In addition, if the number of light emitting chips 32 is increased, a light emission surface is also increased and thus in order to receive the light from such a large light emission surface without being wasted, there is a need to increase the size of the first lens part 61 per se of the first lens 60.

Therefore, for the sake of downsizing, it is preferable that the heat value be restrained by providing the light emitting chips 32 on the one by one basis for each light distribution pattern so that the first lens 60 can be disposed so as to be close to the light source 30, and the light emitting chips 32 be employed on the one by one basis for each light distribution pattern and then a state in which the lens is close to a spot light source of which light emission area be small is established to thereby able to reduce the size of the first lens part 61 per se required to receive the light without being wasted.

Incidentally, the light source part may be composed of the plurality of light sources 30 by providing the light sources 30 on the one by one basis for each light distribution pattern. In this case as well, the plurality of light emitting chips 32 are provided in a set for each light source 30; and however, even in a case where the light source part is composed of the plurality of light sources 30 from the viewpoints of downsizing, it is preferable that the number of light emitting chips 32 provided for each light source 30 be limited to one.

In the meantime, there may be a case in which the light emitting chips 32 each partially include a cutout depending on the manufacturers, and in a case where each of these chips thus partially includes a cutout, it is preferable that such a cutout portion be disposed so as to be located downward in the vertical direction. By doing something like this, light beams from the cut out portions are projected upward and then are released upward of the light distribution pattern to be thereby able to form an appropriate light distribution pattern.

Incidentally, in the embodiment, the three light emitting chips 32 are employed to form the three light distribution patterns, i.e., the short dispersion light distribution pattern, the middle dispersion light distribution pattern, and the large dispersion light distribution pattern; and however, it may be that only the short dispersion light distribution pattern and the large dispersion light distribution pattern are formed without forming the middle dispersion light distribution pattern and then the short dispersion light distribution pattern and the large dispersion light distribution pattern are overlapped each other so as to form a high beam light distribution pattern.

In such a case, as the light emitting chips 32, there may be provided a total of two light emitting chips 32, i.e., a light emitting chip 32 for short dispersion light distribution pattern and a light emitting chip 32 for large dispersion light distribution pattern.

Incidentally, as is the case in which the light source part is composed of the plurality of light sources 30 as well, when only the short dispersion light distribution pattern and the large dispersion light distribution pattern are formed, it is sufficient that the light source part is composed of the two light sources 30 in accordance therewith. In addition, although the embodiment presents a case in which a LED is employed as a semiconductor-type light source 30, for example, a semiconductor-type light source such as a semiconductor laser (LD) may be employed.

(Lens Holder)

The lens holder 40 consists of: a first lens holder 41 which is disposed at the light source 30 side; and a second lens holder 42 which is disposed at a front side of the first lens holder 41.

In the first lens holder 41, a boss hole 41*a* through which the boss 24 of the heat sink 20 is to be inserted and a screw hole 41*b* through which a screw (not shown) is to be passed are respectively formed at both ends in a horizontal direction. After the first lens holder 41 has been disposed on the heat sink 20 so as to pass the boss 24 of the heat sink 20 through the boss hole 41*a*, the screw (not shown) is screwed and fixed into the screw fixing hole 25 of the heat sink 20 through the screw hole 41*b* so as to be thereby able to mount the lens holder to the heat sink 20.

Similarly, in the second lens holder 42 as well, a boss hole 42*a* through which the boss 26 of the heat sink 20 is to be inserted and a screw hole 42*b* through which a screw (not shown) is to be inserted are formed at both ends in the horizontal direction. After the second lens holder 42 has been disposed on the heat sink 20 so as to pass the boss 26 of the heat sink 20 through the boss hole 42, a screw (not shown) is screwed and fixed into the screw fixing hole 27 of the heat sink 20 through the screw hole 42*b* so as to be thereby able to mount the lens holder to the heat sink 20.

Also, at a center of the first lens holder 41, an opening 43 is formed. At both sides (an upper side and a lower side) in the vertical direction of the opening 43 at the center thereof, receptacle parts 44 to receive both edges (an upper edge and a lower edge) in the vertical direction of the first lens are respectively formed.

In addition, on both surfaces (an upper surface and a lower surface) in the vertical direction of the first lens holder 41, engagingly stop parts 45 to engagingly stop at the second lens holder 42 are respectively formed.

On the other hand, at a center of the second lens holder 42 as well, an opening 46 is formed. At both sides in a horizontal direction of a front side of the opening 46 at the center thereof, front surface wall parts 47 to receive both ends in a horizontal direction of a second lens 50 are respectively formed.

In addition, on both side walls (a left side wall and a right side wall) in the horizontal direction of the second lens holder 42, engagingly stop parts 48 to engagingly stop at the first lens holder 41 are respectively formed.

Therefore, in a state in which the first lens 60 is received by the receptacle part 44 of the first lens holder 41 and the second lens 50 is received by the front surface wall part 47 of the second lens holder 42, the first lens 60 and the second lens 50 are held so as to be sandwiched between the first lens holder 41 and the second lens holder 42.

Incidentally, a shade 70 is held so as to be sandwiched between the first lens 60 and the second lens 50.

(First Lens)

The first lens 60 is formed in a shape of a transversely elongated plate in the horizontal direction, and three first lens parts 61 which correspond to the respective light emitting chips 32 are formed. The first lens 60 is disposed so that a backward focal point of the first lens part 61 is positioned at or near a center of the light emitting chip 32 of the light source 30, namely, at or near a light emission center of the light source 30.

Therefore, if the backward focal length of the first lens part 61 is formed so as to be short, i.e., 3 mm or more and 10 mm or less, the first lens 60 can be disposed near the light source 30.

However, if the first lens 60 is thus disposed near the light source 30, there is an apprehension that the first lens 60 is thermally degraded due to an effect of a heat from the light source 30.

Thus, it is preferable that the first lens 60 be formed of any material such as a polycarbonate-based resin, silicone (SLR), and a glass of which heat resistivity is excellent. In the embodiment, the first lens 60 is formed of a polycarbonate-based resin.

An incident surface (a surface at the light source side) where the light from the light source 30 of the first lens part 61 is allowed to enter is formed as a composite quadrature curved surface which is formed by the two axes in the horizontal direction and the vertical direction. Although, in the embodiment, an incident surface in the shape of a flat plate is formed so that an axis in the horizontal direction and an axis in the vertical direction are defined by the straight lines, for example, this surface may be an incident surface as curved in the first lens part 61, in which the axis in the horizontal direction is defined by the straight line and the axis in the vertical direction is defined by the inwardly curved curve.

On the other hand, an emission surface of the first lens part 61 is formed as a free curved surface so that the light thus allowed to enter is radiated to the second lens 50 side, as a predetermined emission pattern.

Incidentally, light distribution control of the first lens part 61 will be described later.

In addition, as described above, in a case where only the short dispersion light distribution pattern and the large dispersion light distribution pattern are formed by employing the two light emitting chips 32 and the middle dispersion light distribution pattern is not formed, two first lens parts 61 are formed in the first lens 60 in accordance therewith.

(Shade)

The shade 70 is a member for shading light so as not to allow emission of the light from a portion other than the first lens part 61 of the first lens 60.

Thus, in so far as the shade 70 is concerned, three openings 71, each of which is adaptive to an outer diameter of the first lens part 61, are formed, and are formed so as to shade a portion other than the first lens part 61 in the first lens 60 while the light to be emitted from the first lens part 61 is not allowed to be shaded.

Incidentally, as described above, in a case where the number of the first lens parts 61 is two, the number of openings 71 is also two in association therewith.

(Second Lens)

The second lens 50 is formed in a shape of a transversely elongated plate in the horizontal direction, and three second lens parts 51 which correspond to the respective light emitting chips 32 are formed.

An emission surface from which the light of the second lens part 51 is to be emitted may be freely determined according to a required surface shape. On the other hand, an incident surface (a surface at the first lens part 61 side) where the light of the second lens part 51 is allowed to enter is formed as a free curved surface so that the light to be emitted from the emission surface becomes a predetermined emission pattern.

In the embodiment, the emission surface of the second lens part 51 is formed in the shape of a flat plate, whereas the incident surface is formed as a free curved surface so that the light to be emitted from the emission surface becomes a predetermined emission pattern.

Incidentally, light distribution control of the second lens part 51 will be described later.

Here, in general, even with the same material, if the wavelength is different, the refractive index is also different. If the wavelength dependency of the refractive index is great, dispersion is prone to readily take place, and a blue spectral color is prone to readily appear in a part of the light distribution pattern.

The second lens 50 is positioned at the front side of the first lens 60 and it is hardly affected by the heat from the light source 30; and therefore, it is preferable that a spectral influence be reduced by employing an acrylic resin such as PMMA of which wavelength dependency of refractive index is small.

Accordingly, as is evident from the descriptive matters of the first lens 60 and the second lens 50, in the embodiment, the first lens 60 is formed of a polycarbonate resin (a material of which heat resistivity is higher than that of the second lens 50) while a higher priority is assigned to the viewpoint of heat resistivity, and on the other hand, the second lens 50 is formed of an acrylic resin while a higher priority is assigned to the viewpoint of dispersion.

Incidentally, as described above, in a case where only the short dispersion light distribution pattern and the large dispersion light distribution pattern are formed by employing the two light emitting chips 32 and the middle dispersion light distribution pattern is not formed, two second lens parts 51 are formed in the second lens 50 in accordance therewith.

Next, with reference to FIG. 3, the first lens part 61 and the second lens part 51 will be further described in detail.

FIG. 3 is a view showing the first lens part 61 and the second lens part 51 forming a large dispersion light distribution pattern.

Incidentally, in FIG. 3, surface shapes of incident surfaces 62, 52 and emission surfaces 63, 53 with respect to the first lens part 61 and the second lens part 51 are shown.

In addition, in FIG. 3, a central side of the emission surface 53 is lesser with respect to the light beams that are radiated from the emission surface 53 of the second lens part 51. This is because, when light beams are simply described in equal pitches from the light sources 30 (the light emitting chips 32), the light beams are not emitted from the central side of the emission surface 53 as well.

Namely, this is a mere illustration such that the light beams that are emitted from the central side of the emission surface 53 are lesser according to a mere relationship of decimation at the time of describing the light beams.

FIG. 3 shows: the light emitting chip 32 of the light source 30 for forming a large dispersion light distribution pattern; the incident surface 62 and the emission surface 63 of the first lens part 61; and the incident surface 52 and the emission surface 53 of the second lens part 51, and also shows how the light from the light emitting chip 32 is subjected to light distribution control by the first lens part 61 and the second lens part 51.

In FIG. 3, reference uppercase letter Z designates an optical axis (hereinafter, referred to as the "light source optical axis Z") of the light from the light source 30 (the light emitting chip 32), and reference uppercase letter X designates a horizontal axis X which is orthogonal to the light source optical axis Z.

In addition, in FIG. 3, reference uppercase letter P designates a basic focal point P (a backward focal point) of the second lens part 51, and reference uppercase letter C designates a cone C which connects the second lens part 51 and the basic focal point P of the second lens part 51 to each other.

As shown in FIG. 3, the second lens part 51 is disposed near the light source 30 and thus the basic focal point P of the second lens part 51 is positioned at a rear side much more significantly than the light emitting chip 32.

In addition, as is evident by referring to FIG. 3, the light cone LC (light dispersion) of the light emitting chip 32 disperses more rapidly than the cone C that connects the second lens part 51 and the basic focal point P of the second lens part 51 to each other, and the dispersion of the cone C and the dispersion of the light cone LC are not coincident with each other.

Accordingly, between the light emitting chip 32 and the second lens part 51, there is disposed the first lens part 61 to convert the light cone LC from the light emitting chip 32 (the light source 30) so as to be adaptive to the dispersion state of the cone C that connects the second lens part 51 and the basic focal point P of the second lens part 51 to each other.

However, as is evident by referring to FIG. 3, even if the light allowed to enter the incident surface 62 outside in the horizontal direction of the first lens part 61 is converted to the state of a dispersion angle which is similar to the dispersion state of the cone C, it follows that the light is radiated to the outside of the incident surface 52 of the second lens part 51.

Accordingly, further, the first lens part 61 is formed to inwardly convert and radiate, to the second lens part 51, the light from the light source 30 (light emitting chip 32) allowed to enter the incident surface 62 outside in the horizontal direction of the first lens part 61, so as to be allowed to enter the incident surface 52 outside in the horizontal direction of the second lens part 51.

Specifically, in respect of the light allowed to enter the incident surface 62 outside in the horizontal direction of the first lens part 61 in which an irradiation angle θ of the light from the light from the light source 30 (the light emitting chip 32) relative to the incident surface 62 of the first lens part 61) is 35 degrees or more with reference to the light source optical axis Z, when the light from the emission surface 63 is emitted, the emission surface 63 is formed in such a manner that the emitted light is inwardly converted and radiated so as to be allowed to enter the incident surface 52 outside in the horizontal direction of the second lens part 51.

Incidentally, in the embodiment, the light allowed to enter the incident surface 62 outside in the horizontal direction of the first lens part 61 of which irradiation angle θ is 35 degrees or more is not allowed to enter the incident surface 52 unless the light is inwardly converted and radiated to the second lens part 51; and therefore, the light allowed to enter the incident surface 62 outside in the horizontal direction of the first lens part 61 of which irradiation angle θ is 35 degrees or more is inwardly converted so as to be thereby radiated to the second lens part 51. However, needless to say, the fact that the irradiation angle θ is 35 degrees or more is not indispensably required.

As described above, when the light allowed to enter the incident surface 62 outside in the horizontal direction of the first lens part 61 has been converted to the state of the dispersion angle that is similar to the dispersion state of the cone C, it is sufficient that the light allowed to enter the incident surface 62 outside in the horizontal direction of the first lens part 61 for entry of the light to be radiated to the outside more significantly than the incident surface 52 of the second lens part 51 is inwardly converted so as to be thereby radiated to the second lens part 51.

Here, let us consider a case in which the first lens part 61 is not provided. First, in order to ensure that the basic focal point P of the second lens part 51 is positioned at or near the light emission center of the light source 30, there is a need to dispose the second lens part 51 at the front side much more significantly. In addition, in order to allow the light from the light source 30 (the light emitting chip 32) to enter the second lens part 51 without being wasted, there is a need to employ a large second lens part 51 so as to be adaptive to dispersion of the light cone LC of the light source 30 (the light emitting chip 32).

On the other hand, in the embodiment, between the second lens part 51 and the light source 30, the first lens part 61 is provided so as to be able to be disposed to be close to the light source 30 while it is formed so that the backward focal distance is reduced. By the first lens part 61, dispersion of the light cone LC of the light source 30 (the light emitting chip 32) is converted to the state of the dispersion angle that is similar to the dispersion state of the cone C that connects the second lens part 51 and the basic focal point P of the second lens part 51 to each other. Further, the light allowed to enter the incident surface 62 outside in the horizontal direction of the first lens part 61, the light being allowed to come off of the incident surface 52 of the second lens part 51 in the case of the conversion only, is inwardly converted to be allowed to enter the incident surface 52 outside in the horizontal direction of the second lens part 51 so as to be thereby radiated to the second lens part 51.

Therefore, the second lens part 51 can be disposed to be significantly close to the light source 30 so as to be able to remarkably reduce the size of the second lens part 51 as well, and it is possible to downsize the lamp unit 10 and thus downsizing of the vehicle lamp unit can be carried out, accordingly.

In addition, the light from the light source 30 (the light emitting chip 32) can be allowed to enter the second lens part 51 without being wasted and thus it is possible to provide a lamp unit 10 of which light utilization efficiency is high, namely, a vehicle lamp of which light utilization efficiency is high.

Next, referring to light distribution control of the second lens part 51, the second lens part 51 is formed so as to radiate light from the outside to the inside from the central side to the outside in the horizontal direction.

More specifically, the incident surface 52 of the second lens part 51 has two convex portions forming a convex shape towards the light source 30 side outside in the horizontal direction more than the center. The center that is a portion to which these convex shapes connect is formed in an inwardly concaving shape, and the light thus allowed to enter the central side of the incident surface 52 of the second lens part 51 is radiated to the outside in the horizontal direction from the emission surface 53, so that the light allowed to enter the outside in the horizontal direction of the incident surface 52 of the second lens part 51 is radiated to the inside (the light source optical axis Z).

By doing something like this, the light thus allowed to enter the outside in the horizontal direction of the incident surface 52 of the second lens part 51 can be utilized at the central side of the light distribution patter by the first lens part 61 described previously.

FIG. 4 shows, by the iso-intensity curve, a state of a light distribution pattern on a screen which is formed by the light from each light source.

Incidentally, FIG. 4 shows a light distribution pattern on the screen at an upper side, and shows a view which is similar to that of FIG. 3 at a lower side, in which the line VU-VD designates a vertical line, and the line HL-HR designates a horizontal line.

FIG. 4 (*a*) shows the large dispersion light distribution pattern described above; FIG. 4 (*b*) shows the middle dispersion light distribution pattern; and FIG. 4 (*c*) shows the short dispersion light distribution pattern.

In order to form the middle dispersion light distribution pattern and the short dispersion light distribution pattern shown in FIG. 4 (*b*) and FIG. 4 (*c*), respectively, it is sufficient that the basic configuration is made similar to that of the portion forming the large dispersion light distribution pattern and the shape of the incident surface 52 of the second lens part 51 is adjusted to be adaptive to the dispersion or the like in the horizontal direction of the light distribution pattern.

Specifically, at the portions forming the middle dispersion light distribution pattern and the short dispersion light distribution pattern as well, open or cross light distribution control is carried out as described above. Thus, the fact that the incident surface 52 of the second lens part 51 has the two convex portions that are shaped to be convex towards the light source 30 side outside in the horizontal direction more significantly than the center is the same as the portion forming the large dispersion light distribution pattern; and however, it is sufficient that the curvature of the convex shape is made gentle so as to be adaptive to the dispersion in the horizontal direction of the light distribution pattern.

Incidentally, at the central side of the incident surface 52 of the second lens part 51 forming the middle dispersion light distribution pattern and the short dispersion light distribution pattern, the curvature of the convex shape is made gentle as described above and thus inward concaveness becomes small.

The thus formed large dispersion light distribution pattern, middle light distribution pattern, and short dispersion light distribution pattern are multiplexed with each other, and a high beam light distribution pattern is thereby formed.

In the meantime, if the plurality of light distribution patterns are thus multiplexed with each other, the luminous intensity is high, accordingly, at a portion at which the light distribution patterns have overlapped each other, and the luminous intensity is low, accordingly, at a portion at which these patterns are not formed in an overlapping manner.

Thus, at a portion at which only the large dispersion light distribution pattern is formed and at a portion at which the middle dispersion light distribution pattern is multiplexed, there may be a case in which a light aberration appears at the boundary of the outer circumferential contour of the middle dispersion light distribution pattern and a streak exerted by the light aberration along the outer circumferential contour of the middle dispersion light distribution pattern appears.

In addition, similarly, there may be a case in which a streak exerted by the light aberration along the outer circumferential contour of the short dispersion light distribution pattern appears. Accordingly, in order to ensure that such a streak does not appear, it is preferable to blur the outer circumferential contour of each of the middle dispersion light distribution pattern and the short dispersion light distribution pattern.

On the other hand, in respect of the outer circumferential contour of the large dispersion light distribution pattern, if an outer circumferential contour with its sharp, clear contrast other than the streaks described above is formed, it becomes rapidly darkened at the boundary of the outer circumferential contour and thus the visual recognition property lowers.

Thus, it is preferable to blur the outer circumferential contour in the large dispersion light distribution pattern as well.

Hereinafter, with reference to FIG. 5, a method for blurring an end of a light distribution pattern will be described.

FIG. 5 is a view schematically showing that an irradiation angle of the light that is radiated from the light sources 30 (the light emitting chips 32) in the horizontal direction and the vertical direction is within the range of 50 degrees with respect to the incident surface 62 of the first lens part 61.

In FIG. 5, in the same manner as described above, reference uppercase letter X designates the horizontal axis X that is orthogonal to the light source optical axis Z and the vertical axis Y, and similarly, the light emitting chips 32 that are positioned on the light source optical axis Z, each of which is indicated as a dot, are described on the vertical axis X for the sake of explanation.

In addition, reference uppercase letter Y designates the vertical axis Y that is orthogonal to the light source optical axis Z and the horizontal axis X, and similarly, the light emitting chips 32 that are positioned on the light source optical axis Z, each of which is indicated as a dot, are described on the vertical axis Y for the sake of explanation.

As has been described so far with reference to FIG. 3, the first lens part 61 is intended to convert the light cone LC (refer to FIG. 3) of the light source 30 (the light emitting chip 32) to the cone C that connects the second lens part 51 and the basic focal point P of the second lens part 51 to each other. On the other hand, in respect of a portion of the incident surface 62 of the first lens part 61 indicated by the straight line that connects a dot and a dot to each other in FIG. 5, the incident surface 62 is formed so that the focal point position of the second lens part is focally shifted in the vertical direction by a substantial distance indicated by a positive or negative numeric value (in units of millimeters) shown in FIG. 5 with respect to the basic focal point P when it is seen from the second lens part 51 side.

Incidentally, a positive numeric value of FIG. 5 designates a focal shift to an upper side in the vertical direction, and a negative one designates a focal shift to a lower side in the vertical direction.

Namely, although FIG. 5 shows an angle θ' by drawing a line from the vertical axis X to the incident surface 62, this angle indicates that an irradiation angle of the light that is radiated from the light source 30 (the light emitting chip 32) to the incident surface 62 is within the range of the angle θ' in the vertical direction with reference to the light source optical axis Z. In addition, the incident surface 62 in which the irradiation angle of the light that is radiated from the light source 30 (the light emitting chip 32) to the incident surface 62 is within the range of the predetermined angle θ' or less is formed so as to shift the focal point position in the vertical direction. In the embodiment, the predetermined angle θ' is set to 25 degrees.

Incidentally, the entire range in the vertical direction of the incident surface 62 shown in FIG. 5, as described above, is characterized by the fact that the irradiation angle of the light that is radiated from the light source 30 (the light emitting chip 32) to the incident surface 62 is within the range of 50 degrees (50 degrees at the upper side and 50 degrees at the lower side in the vertical direction) with reference to the light source optical axis Z.

On the other hand, although FIG. 5 shows an angle α by drawing a line from the vertical axis Y to the incident surface, this angle indicates that an irradiation angle of the light that is radiated from the light source 30 (the light emitting chip 32) to the incident surface 62 is within the range of the angle α in the vertical direction with reference to the light source optical axis Z. The entire range in the horizontal direction of the incident surface 62 shown in FIG. 5, as described above, is characterized by the fact that the irradiation angle of the light that is radiated from the light source 30 (the light emitting chip 32) to the incident surface 62 is 50 degrees (50 degrees at the left side and 50 degrees at the right side in the horizontal direction).

In addition, a configuration in which a focal point position is shifted in the vertical direction is provided in the entire range in the horizontal direction of the incident surface 62, as shown in FIG. 5, when it is seen in the horizontal direction; and however, this configuration is made different depending on a proximal axis area in which the irradiation angle of the light in the horizontal direction that is radiated from the light source 30 (the light emitting chip 32) to the incident surface 62 is within the range of the angle α (25 degrees) with reference to the light source optical axis Z and an area in which the angle is more outside than 25 degrees.

A portion at which the focal point position is to be shifted in the vertical direction is thus formed on a part of the incident surface 62, and the light having been allowed to enter this portion is thereby radiated to a front side so as to be slightly vertically vibrated, and an end of a light distribution pattern can be blurred.

In addition, a structure for blurring is formed on the incident surface 62 of the first lens part 61 that are capable of forming a comparatively simple surface shape, thereby making it unnecessary to further add a configuration for blurring an end of a predetermined light distribution pattern, to the incident surface 52 of the second lens part 51 that is designed to form the predetermined light distribution pattern according to the shape of the emission surface 53. In this manner, light distribution control for forcible blurring does not need to be carried out at the second lens part 51.

FIG. 6 shows, by the iso-intensity curve, a high beam light distribution pattern on a screen which is formed by the lamp unit 10 consisting of the constituent elements as described above.

Incidentally, in FIG. 6, the line VU-VD designates a vertical line, and the line HR-HR designates a horizontal line.

As described above, due to blurring of the outer circumferential contour of the large dispersion light distribution pattern, as shown in FIG. 6, it is found that a plurality of iso-intensity curves are seen in the vicinity of the outer circumference of the high beam light distribution pattern, and the luminous intensity is established in its gently lowering state.

Thus, rapid darkening at the outside of the high beam light distribution pattern is restrained, and it is found that the high beam light distribution pattern can be well visually recognized.

Also, due to blurring of the outer circumferential contour of the middle dispersion light distribution pattern, in the high beam light distribution pattern, a streak exerted by a difference on luminous intensity does not appear, although such a streak is prone to appear at the boundary between a portion which is composed of only the large dispersion light distribution pattern and a portion at which the middle dispersion light distribution pattern has been multiplexed. In addition, due to blurring of the outer circumferential contour of the short dispersion light distribution pattern, similarly, in the high beam light distribution pattern, a streak exerted by a difference in luminous intensity does not appear, although such a streak is prone to appear at the boundary between a portion at which the short dispersion light distribution pattern has been multiplexed and a portion at which no such pattern has been multiplexed. Therefore, an appropriate high beam light distribution pattern is formed.

Incidentally, as described above, a respective one of the large dispersion light distribution pattern, the middle dispersion light distribution pattern, and the short dispersion light distribution pattern is formed by open or cross light distribution control, and the spectral colors of the respective light distribution patterns are thereby mixed with each other, and it is possible to form a light distribution pattern free of color non-uniformity, having restrained the spectral color in the high beam light distribution pattern.

In the meantime, in the foregoing description, there has been set forth the lamp unit 10 in which the portions forming the respective dispersion light distribution patterns have been provided so as to be arranged in the vertical direction.

In this case, it is preferable that the portions forming the respective dispersion light distribution patterns be disposed as shown in FIG. 7.

FIG. 7 is a front view of the lamp unit 10, and the inside of the vehicle is at the left side of the figure and the outside of the vehicle is at the right side of the figure.

As shown in FIG. 7, in view of multiplexing the respective light distribution patterns, it is preferable that the portion forming the large dispersion light distribution pattern that is the broadest light distribution be provided at a center of the lamp unit 10 and the portions forming the middle dispersion light distribution pattern and the short dispersion light distribution pattern be provided at an end side in the horizontal direction of the lamp unit 10. At that time, from the viewpoints of restraining light irradiation pertinent to an inner panel or the like inside of the vehicle, it is preferable that the portion forming the short dispersion light distribution pattern be provided at an end inside of the vehicle in the horizontal direction, and the portion forming the middle dispersion light distribution pattern be provided at an end outside of the vehicle in the horizontal direction.

Incidentally, in a case where the portion forming the middle dispersion light distribution pattern is not provided, it is sufficient that the portion forming the middle dispersion light distribution pattern is eliminated while the state of the layout described above is kept as it is.

Namely, it is sufficient that the portion forming the short dispersion light distribution pattern is positioned inside of the vehicle, and the portion forming the large dispersion light distribution pattern is positioned outside of the vehicle.

On the other hand, in a case where a lamp unit for low beam is provided outside of the vehicle and the lamp unit 10 for high beam, according to the present invention, is provided inside of the vehicle, it is preferable to reduce the size in a widthwise direction while the lamp unit 10 is disposed as the one of a vertical type such that the lamp unit is rotated at 90 degrees from the state shown in FIG. 7.

Incidentally, although it is deemed to be needless to say, in the case where the lamp unit 10 is the one of such a vertical type, in so far as a relationship in orientation among the light emitting chip 32, the first lens part 61 and the second lens part 51 is concerned, unless the relationship between the horizontal direction and the vertical direction described above is maintained, it follows that the vertical direction and the horizontal direction of the light distribution pattern thus formed are exchanged from with each other. Therefore, in order to obtain the lamp unit 10 of such a vertical type, a mere rotation of the orientation at 90 degrees is not sufficient, and the respective portions forming the respective dispersion light distribution patterns shown in FIG. 7 need to be formed so as to maintain their initial state, i.e., so as to be overlapped each other in the vertical direction.

In the case where the lamp unit 10 is thus longitudinally elongated in the vertical direction, it is preferable that the portion forming the large dispersion light distribution pattern be positioned at a lower side in the vertical direction, the portion forming the short dispersion light distribution pattern be positioned in the middle in the vertical direction, and the portion forming the middle dispersion light distribution pattern be positioned at the top in the vertical direction.

The portion forming the large dispersion light distribution pattern, as shown in FIG. 4 (*a*), is larger in concaveness at the central side of the incident surface 52 of the second lens part 51 than each of the portion forming the middle dispersion light distribution pattern (refer to FIG. 4 (*b*)) and the portion forming the short dispersion light distribution pattern (refer to FIG. 4 (*c*)); and therefore, when the lamp unit 10 is seen, this lamp unit is disposed at the lower side in the vertical direction in which it is not so often visually seen, so as to be thereby able to improve appearance thereof.

Incidentally, the portion forming the middle dispersion light distribution pattern (refer to FIG. 4 (*b*)) and the portion forming the short dispersion light distribution pattern (refer to FIG. 4 (*c*)) each are smaller in concaveness at the central side of the incident surface 52 of the second lens part 51; and therefore, either one of these portions may be disposed at an upper side in the vertical direction in terms of appearance thereof.

Hereinbefore, while the present invention has been described so far by way of the specific embodiment, the present invention is not limitative to the embodiment described above.

Although, in the embodiment, the range in the vertical direction of the incident surface 62 of the first lens part 61, in which the focal point position is shifted in the vertical direction, was equivalent to an range to an extent such that the irradiation angle in the vertical direction of the light from the light source 30 is 25 degrees or less with reference to the light source optical axis Z of the light source 30, this range may be equivalent to a range to an extent such that the irradiation angle is a predetermined angle θ' which is selected from the range of 20 degrees or more and 30 degrees or less.

Therefore, the present invention is not limitative to the specific embodiment, alterations or modifications are also encompassed in the technical scope of the invention without departing from the technical idea, and such alterations and modification are self-evident to one skilled in the art in the light of the claims appended thereto.

DESCRIPTION OF REFERENCE NUMERALS

10 Lamp unit
20 Heat sink
21 Surface
22, 24, 26 Bosses
23, 25, 27 Screw fixing holes
30 Light source
31 Aluminum package board
32 Light emitting chip
33, 41*a*, 42*a* Boss holes
34, 41*b*, 42*b* Screw holes
40 Lens holder
41 First lens holder
42 Second lens holder
43, 46, 71 Openings
44 Receptacle part
45, 48 Front face wall part
47 Front face wall part
50 Second lens
51 Second lens part
60 First lens
61 First lens part
62, 52 Incident surfaces
63, 53 Emission surfaces
70 Shade
C Cone
LC Light code
P Basic focal point
X Horizontal axis
Y Vertical axis
Z Light source optical axis
101L, 101R Vehicle headlamps
102 Vehicle

The invention claimed is:

1. A vehicle lamp comprising:

a light source part having a semiconductor-type light source;

a second lens having a second lens part which is disposed at a front side of the light source; and a first lens disposed between the light source and the second lens and having a first lens part to convert a light cone of the light source to a cone which connects the second lens part and a basic focal point of the second lens part to each other, wherein the first lens part is formed to inwardly convert and radiate light from the light source allowed to enter an incident surface outside in a horizontal direction of the first lens part so as to be allowed to enter an incident surface outside a horizontal direction of the second lens part, and wherein in a case where a cutout is present at a part of a light emitting chip which is provided at the light source, the light emitting chip is disposed so that a cut out portion is positioned at a lower side in a vertical direction.

2. The vehicle lamp unit according to claim 1, wherein the second lens part is formed so as to radiate light from outside to inside from a central side towards outside in a horizontal direction.

3. The vehicle lamp unit according to claim 1, wherein an incident surface in a range in a vertical direction of the first lens part, in which an irradiation angle of light from the light source is a predetermined angle or less with reference to a light source optical axis of the light source, is formed so that a focal point position of the second lens part is shifted in a vertical direction with respect to the basic focal point of the second lens part.

4. The vehicle lamp unit according to claim 1, wherein the first lens part has a backward focal distance of 3 mm or more and 10 mm or less, the first lens is formed of a material with a higher heat resistivity than a material for the second lens, and the first lens is disposed so that a light emission center of the light source part is positioned at or near a backward focal point of the first lens part.

5. The vehicle lamp unit according to claim 1, wherein the second lens is formed of an acrylic resin.

6. The vehicle lamp unit according to claim 1, wherein at the light source part, a plurality of light emitting chips are provided, at the first lens, the first lens part that corresponds to a respective one of the light emitting chips is formed in plurality, and at the second lens as well, the second lens part that corresponds to a respective one of the light emitting chips is formed in plurality.

7. The vehicle lamp unit according to claim 6, comprising a lamp unit for low beam, which is disposed outside of a vehicle, wherein the light emitting chips, the first lens part, and the second lens part are disposed so as to be arranged in a vertical direction at positions adjacent to the lamp unit for low beam at the inside of the vehicle.

8. A vehicle lamp comprising:

a light source part having a semiconductor-type light source;

a second lens having a second lens part which is disposed at a front side of the light source; and a first lens disposed between the light source and the second lens and having a first lens part to convert a light cone of the light source to a cone which connects the second lens part and a basic focal point of the second lens part to each other, wherein the first lens part is formed to inwardly convert and radiate light from the light source allowed to enter an incident surface outside in a horizontal direction of the first lens part so as to be allowed to enter an incident surface outside a horizontal direction of the second lens part, and wherein the semiconductor-type light source includes a light emitting chip, the light emitting chip including a light emitting chip having a cutout at a part thereof, and the light source part being arranged such that as to the light emitting chip having a cutout at a part thereof, the light emitting chip is disposed so that a cut out portion is positioned at a lower side in a vertical direction.

* * * * *